US007481335B2

(12) United States Patent
Owens

(10) Patent No.: US 7,481,335 B2
(45) Date of Patent: Jan. 27, 2009

(54) VARIABLY PROPORTIONAL MIXING CONTAINER

(76) Inventor: James A. Owens, 827 S. Lincoln St., Hinsdale, IL (US) 60521

( * ) Notice: Subject to any disclaimer, the term of this patent is extended or adjusted under 35 U.S.C. 154(b) by 500 days.

(21) Appl. No.: 11/113,929

(22) Filed: Apr. 25, 2005

(65) Prior Publication Data

US 2006/0239114 A1 Oct. 26, 2006

(51) Int. Cl.
*B01F 15/04* (2006.01)

(52) U.S. Cl. ..... 222/144.5; 222/1; 222/145.5; 222/145.7

(58) Field of Classification Search ..... 222/144.5, 222/145.1, 145.5–145.7, 55, 57, 135, 136, 222/1; 366/160.1, 160.5; 251/313
See application file for complete search history.

(56) References Cited

U.S. PATENT DOCUMENTS 2,986,162 A 5/1961 Spexarth
3,581,940 A 6/1971 Cella
3,964,728 A * 6/1976 Flider ..... 251/183
4,069,835 A 1/1978 Stadler
4,819,833 A 4/1989 Huddleston et al.
4,846,373 A 7/1989 Penn et al.
4,971,118 A * 11/1990 Cluff ..... 141/103
4,995,540 A 2/1991 Colin et al.
5,406,995 A 4/1995 Gantzer
6,079,871 A 6/2000 Jonas et al.
6,250,154 B1 6/2001 Cheresko
6,537,246 B1 * 3/2003 Unger et al. ..... 604/82

* cited by examiner

*Primary Examiner*—J. Casimer Jacyna
(74) *Attorney, Agent, or Firm*—Grimes & Battersby, LLP; James F. McLaughlin

(57) ABSTRACT

A variably proportional mixing device is provided for automatically mixing two fluids stored in separate containers in various ratios without measuring, comprising means for selecting one of a plurality of predetermined mix ratios for the two fluids, and a means for controlling the flow of each fluid from the separate containers so as to achieve a mix ratio that corresponds to the selected ratio. In the preferred embodiment, the means for controlling comprises a trigger operated flow control cylinder which controls the flow of fluid from the first container and the second container, and a ratio cylinder including a channel therethrough having a variable cross-sectional area, the rotation of which using the selecting means varies the flow rate of the fluid from the second container into the flow of fluid from the first container. A static mixer is provided for mixing the two fluids in the spout of the device.

18 Claims, 12 Drawing Sheets

VARIABLY PROPORTIONAL MIXING CONTAINER

BACKGROUND OF THE INVENTION

1. Field of the Invention

The present invention relates generally to a variably proportional mixing device, and, more particularly, to such a variably proportional mixing device having two separate reservoirs for fluids such as oil and gasoline and a variably adjustable valve system that allows for the simultaneous pouring and mixing of the two fluids in a wide selection of ratios within the device or the spout thereof.

2. Description of the Prior Art

Systems for mixing two components in a predetermined ratio have long been known in the industry. A particular application of such systems relates to the admixture of two fluids, such as gasoline and oil, which mixture is necessary for the smooth operation of certain types of engines, such as two-cycle engines. Such engines are of the type that are frequently used for household equipment such as mowers, trimmers, blowers, edgers, snow blowers and chainsaws, as well as for recreational purposes, such as motorcycles, jet skis, snowmobiles and boats. Each type of engine may require a different ratio of gasoline to oil, which ratio must be maintained in order to prevent any damage from occurring to the engine and to extend the lifetime of such engine as long as possible.

In the typical system for mixing the fluids, a container is provided for each of the fluids, and a separate container may or may not be provided for the mixture. Since different engines require a different ratio of mixtures, the proper ratio must first be determined, and the appropriate amount of each fluid must then be measured out. Each fluid is then added to the separate container (or one fluid may be added to the other fluid's container) and the two fluids mixed together, such as by shaking. The mixed fluid may then be used in a particular application that requires such a fixed ratio.

The problems with such a system are numerous. First and foremost, only one pre-determined ratio may be mixed in the container at one time. Since many households have more than one two-cycle engine, multiple mixing containers are required to satisfy the various ratios demanded by these different engines. This system also tends to be unreliable, since it requires accurate measuring of each of the separate fluids. This system is also complicated and requires several different containers for mixing just one ratio. Furthermore, regardless of how much of the combined fluid is necessary, this system requires that a fixed amount of each fluid be used (e.g., a gallon of gasoline), often resulting in a tremendous amount of waste.

There are currently a number of such devices currently on the market, including the Gas Canplastic, the 2-Mixer and the Accu-Mix.

Examples of systems for mixing oil and gas in a predetermined ratio are also disclosed in the patent prior art. For example, in U.S. Pat. No. 6,250,154, which issued to Cheresko on Jun. 26, 2001 for "Oil and gas metering and measuring device," teaches a fluid metering and measuring device having a filling chamber with a fluid inlet and a fluid outlet with a plunger disposed within the chamber to create a vacuum in the chamber to cause a fluid, e.g. oil to flow into chamber and gradations to indicate the amount of oil drawn into the chamber to ensure proper fluid ratios.

The use of separate chambers for the fluids and a mixing zone is disclosed in U.S. Pat. No. 6,079,871, which issued to Jonas, et al. on Jun. 27, 2000 for "Method and device for combining at least two fluid media," which teaches a device having first and second fluid chambers connected to a flow region and mixing zone and at least one inlet opening for diverting part of the first fluid medium from the first chamber into the second chamber wherein the second chamber is provided with at least one opening into the flow region for discharging the second fluid medium displaced into it by the first fluid medium.

Other examples of containers for use in mixing two fluids, such as oil and gas, include U.S. Pat. No. 4,819,833, which issued to Huddleston, et al. on Apr. 11, 1989 for "Measuring, metering, and mixing can for gasoline and oil" discloses a measuring, metering, and mixing can including gasoline and containers and a plunger-cylinder metering unit for withdrawing a selected amount of oil from the oil container and injecting the same into the gasoline can for producing an oil-gasoline mixture. Similarly, U.S. Pat. No. 4,069,835, which issued to Stadler on Jan. 24, 1978 for "Fuel and lubricant mixer" discloses a device to proportionately mix fuel and lubricant having a cylindrical lubricant container, a columnar fuel delivery inlet which perpendicularly angles to merge with and to feed fuel into a conical funneled mixing chamber immediately below the base of the lubricant supply container, and an axially secured butterfly lever in the line of fuel inlet travel which is depressed by passing fuel to thereby activates a spring-loaded piston valve which allows a proportionate flow of lubricant to the mixing chamber.

Much of the prior art is not necessarily directed to the mixture of oil and gasoline, although it is clearly the intention that such systems and methods may be so used. For example, U.S. Pat. No. 5,406,995, which issued to Gantzer on Apr. 18, 1995 for "Container assembly for mixing liquids in predetermined ratios" discloses a container assembly having an outer container and at least one inner container whose internal volume has the same ratio to the remaining internal volume of the outer container as the desired ratio of liquids to be mixed wherein an orifice in the inner container establishes communication between the lower end portions of the two containers so that a previously mixed liquid mixture of a predetermined ratio resides at the same level in both containers. Similarly, U.S. Pat. No. 4,846,373, which issued to Penn, et al. on Jul. 11, 1989 for "Apparatus for proportioning or for proportioning and mixing plural different fluid compositions" discloses an apparatus for proportioning and dispensing at least two different fluids including a cartridge having separate chambers for containing separate fluid compositions to be proportioned and dispensed and a valve structure for controlling the flow of the fluid compositions through passageways, for preventing run-on of the fluid compositions through the respective passageways due to decompression of the fluid compositions upon removal of an extruding pressure, and thereby for preventing dispensing of the fluid compositions through the respective passageways in proportional ratios other than a desired predetermined proportional ratio.

A control valve particularly suitable for mechanical refrigeration systems is disclosed in U.S. Pat. No. 4,131,128, which issued to Gotzenberger on Dec. 26, 1978 for "Control Valve." This patent discloses a spherical valve operable by turning the valve body about an axis perpendicular to the direction of the fluid flow.

It should be appreciated that the mixing systems need not be limited to fluids. For example, U.S. Pat. No. 4,995,540, which issued to Colin, et al. on Feb. 26, 1991 for "Unit dosage dispenser for dental impression materials" discloses an apparatus for dispensing, in sequence, a unit dosage of several elastomeric impression materials of different viscosities so as to permit a dental impression to be taken under aseptic conditions in the preparation of a dental restoration.

Numerous other examples of mixing systems and methods are described in U.S. Pat. No. 6,736,536, which issued to Jacobs, et al. on May 18, 2004 for "Apparatus and method for measuring, mixing, and dispensing fluids"; U.S. Pat. No. 6,022,134, which issued to Andrews on Feb. 8, 2000 for "Mixing and dispensing container"; U.S. Pat. No. 5,662,249, which issued to Grosse on Sep. 2, 1997 for "All in one measure/funnel/pour/mix/shake container"; U.S. Pat. No. 5,447,245, which issued to Merhar on Sep. 5, 1995 for "Graduated proportioning and mixing container"; U.S. Pat. No. 5,375,742, which issued to Mowry on Dec. 27, 1994 for "Gas-oil mixture aid"; U.S. Pat. No. 5,295,610, which issued to Levison on Mar. 22, 1994 for "Mixing can having a hinged cap with an integral measuring cup"; U.S. Pat. No. 5,123,460, which issued to Reed on Jun. 23, 1992 for "Multi-purpose container system for loading liquid dispenser"; U.S. Pat. No. 5,108,016, which issued to Waring on Apr. 28, 1992 for "Fuel container system"; U.S. Pat. No. 4,860,927, which issued to Grinde on Aug. 29, 1989 for "Blow molded two-compartment container"; U.S. Pat. No. 4,779,993, which issued to Toole on Oct. 25, 1988 for "Oil and gasoline mixing device"; U.S. Pat. No. 4,721,393, which issued to Kwast on Jan. 26, 1988 for "Ratio Mix container"; U.S. Pat. No. 4,589,777, which issued to Soler on May 20, 1986 for "Mixing apparatus"; U.S. Pat. No. 4,480,470, which issued to Tussing on Nov. 6, 1984 for "Gas cap"; U.S. Pat. No. 4,294,273, which issued to Isberg on Oct. 13, 1981 for "Fluid proportioning device"; U.S. Pat. No. 4,292,846, which issued to Barnett on Oct. 6, 1981 for "Liquid proportioning container"; U.S. Pat. No. 4,185,653, which issued to Armstrong, et al. on Jan. 29, 1980 for "Liquid metering and mixing device"; U.S. Pat. No. 4,079,629, which issued to Hope on Mar. 21, 1978 "Oil to gasoline ratio measuring device"; U.S. Pat. No. 3,948,105, which issued to Johnson, Jr. on Apr. 6, 1976 for "Proportioning and mixing graduate"; U.S. Pat. No. 3,720,231, which issued to Ajero on Mar. 13, 1973 for "Add-on Oil-Fuel Metering Device"; U.S. Pat. No. 3,658,204, which issued to Bottger on Apr. 25, 1972 for "Set of Containers for Two Liquids"; U.S. Pat. No. 3,581,940, which issued to Cella on Jun. 1, 1971 for "Multiple compartment dispenser container with check valves"; and U.S. Pat. No. 2,986,162, which issued to Spexarth on May 30, 1961 for "Apparatus for providing a proper mixture of fuel and oil for an internal combustion engine."

As will be appreciated, none of these prior patents even address the problem faced by applicant let alone offer the solution proposed herein.

SUMMARY OF THE INVENTION

Against the foregoing background, it is a primary object of the present invention to provide a variably proportional mixing device including a single pre-mix device for combining and mixing two fluids in various ratios.

It is another object of the present invention to provide such a variably proportional mixing device that is easy to operate.

It is still another object of the present invention to provide such a variably proportional mixing device that allows for mixtures in various ratios to be poured without having to measure each component.

It is another object of the present invention to provide such a variably proportional mixing device that is consistent and reliable.

It is but another object of the present invention to provide such a variably proportional mixing device that combines and mixes the two fluids simultaneously.

It is yet still another object of the present invention to provide such a variably proportional mixing device that allows ratios to be changed instantly without having to exchange parts.

It is but another object of the present invention to provide such a variably proportional mixing device that may be globally accepted, regardless of the measuring units used for each component.

To the accomplishments of the foregoing objects and advantages, the present invention, in brief summary, comprises a variably proportional mixing device for automatically mixing two fluids stored in separate containers. The device comprises means for selecting one of a plurality of predetermined mix ratios for the two fluids, and a means for controlling the flow of each fluid from the separate containers so as to achieve a mix ratio that corresponds to the selected ratio. In the preferred embodiment, the means for controlling comprises a trigger operated flow control cylinder which controls the flow of fluid from the first container and the second container, and a ratio cylinder including a channel therethrough having a variable cross-sectional area, the rotation of which using the selecting means varies the flow rate of the fluid from the second container into the flow of fluid from the first container. A static mixer is provided for mixing the two fluids in the spout of the device.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

DETAILED DESCRIPTION OF THE INVENTION

Figure 1:
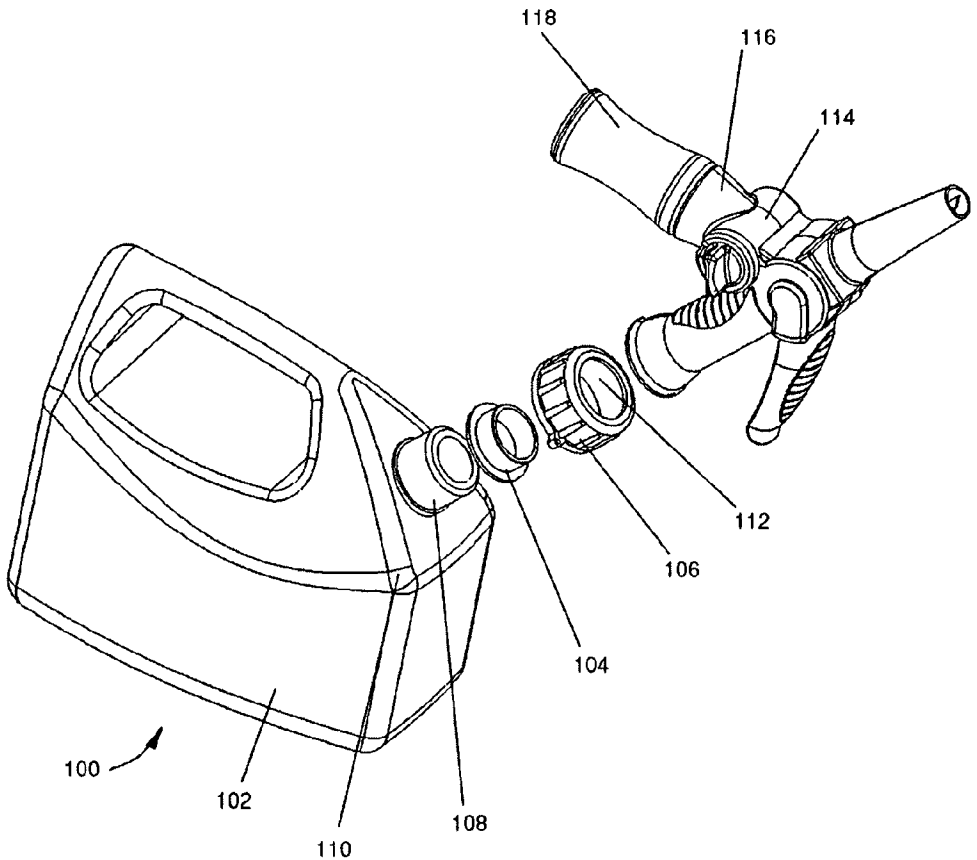
FIG. 1 is a front perspective view of the variably proportional mixing device of the present invention.
Figure 2:
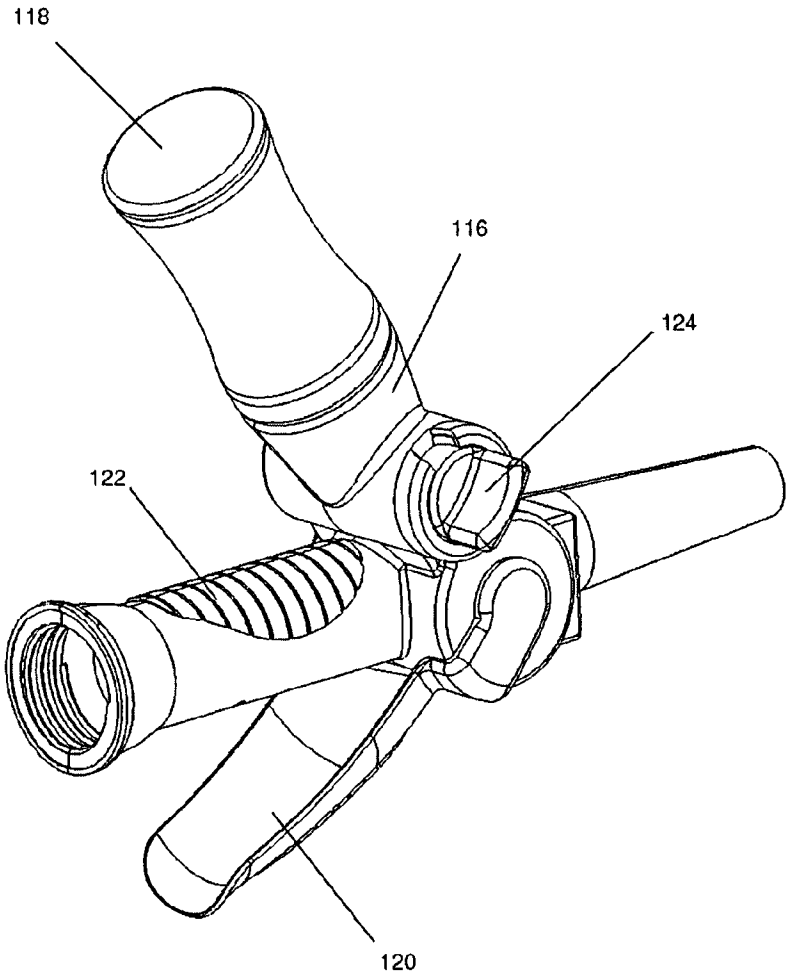
FIG. 2 is a front perspective view of the variably proportional mixing device of FIG. 1.
Figure 3:
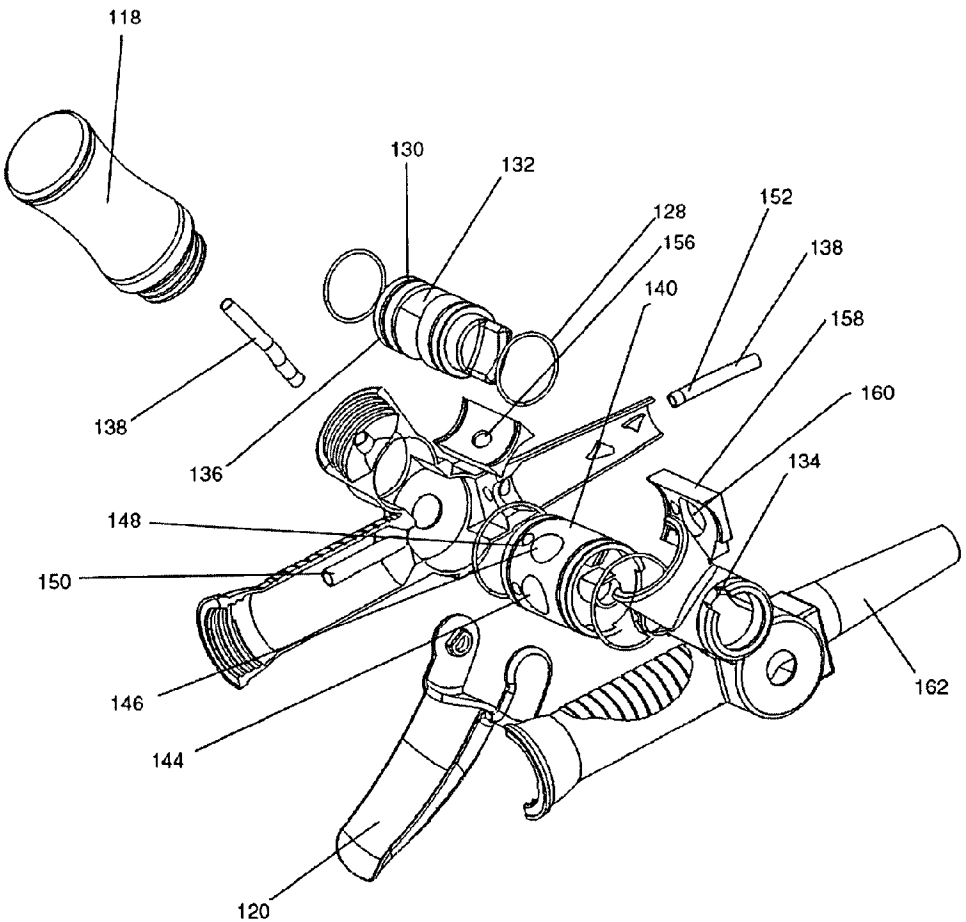
FIG. 3 is an exploded perspective view of the variably proportional mixing device of FIG. 1 showing the elements of the nozzle thereof.
Figure 4A:
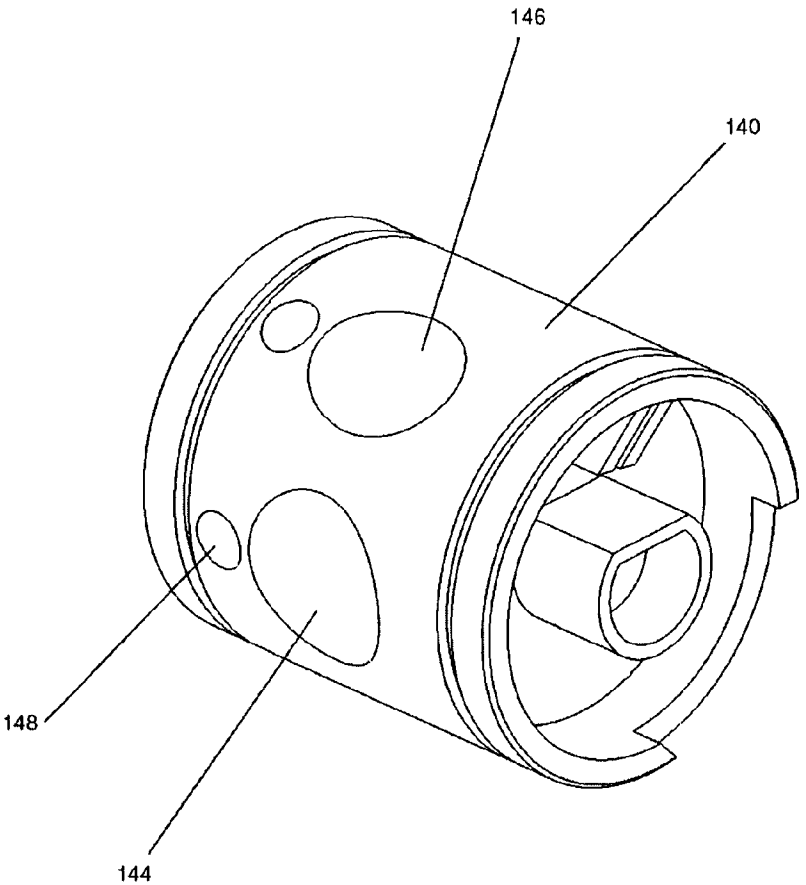
FIGS. 4A and 4B are perspective views of the fuel cylinder and oil ratio cylinder of the variably proportional mixing device of FIG. 1.
Figure 4B:
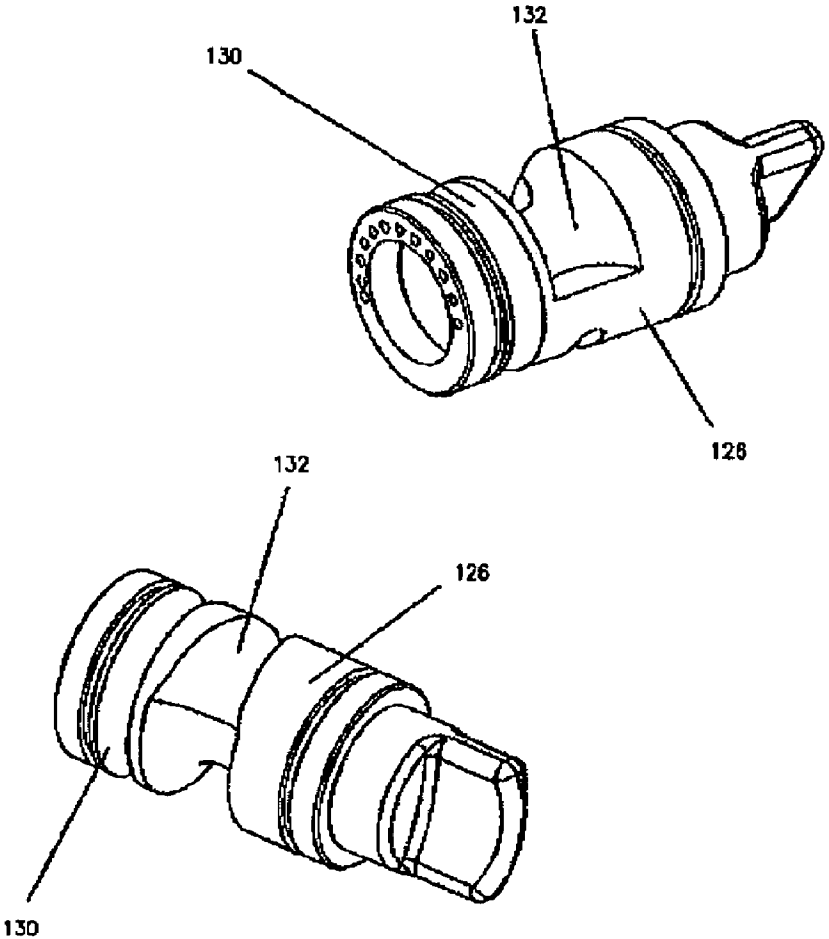
Figure 5:
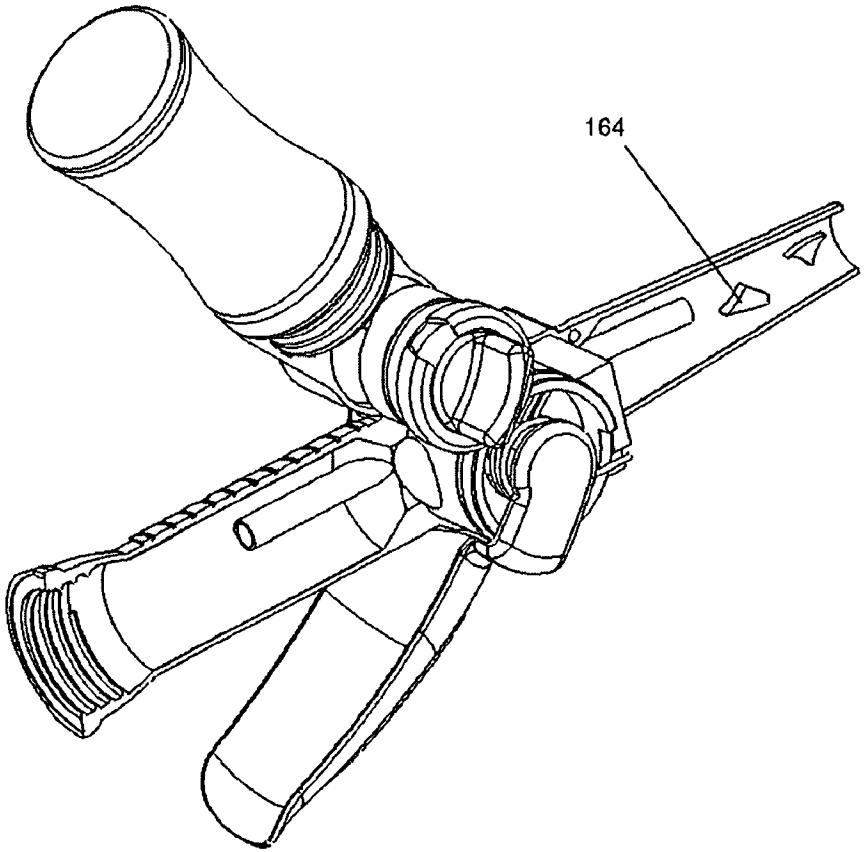
FIG. 5 is an exploded view of the variably proportional mixing device of FIG. 1 showing the operation of the device.

Referring to the drawings and, in particular, to FIGS. 1-3 thereof, the variably proportional mixing device of the present invention, referred to generally by reference numeral 10, is illustrated. The system an automatic closure dosing apparatus 100 which may be attached directly to a first canister 102 for the storage of a fluid such as fuel by means of an adapter ring 104 which is engaged by a threaded ring 106 which in turn is threaded onto the canister spout 108, such that the adapter ring 104 includes external threads 110 which engage corresponding internal threads 112 in the automatic closure apparatus 100 allowing the automatic closure apparatus 100 to be screwed into the adapter ring 104.

In such embodiment, the automatic closure apparatus 100 includes a nozzle housing 114, preferably molded out of two halves, and a housing assembly 116 into which a second canister 118 may be attached. The second canisters 118 may be attached to the housing assembly 116 by a variety of means, such as friction fit or vacuum seal, although in the preferred embodiment the second canister 118 is screwed into the housing assembly 116 to thereby provide a secure and water-tight fit.

Also provided on the nozzle housing 114 is a handle 120 and handle housing 122 which allow a user to operate the closure apparatus 100. The ratio of the fluids to be mixed from the first and second canisters 102, 118 is controlled by a ratio adjustment knob 124 which is also disposed on the outside of the nozzle housing 114. The ratio adjustment knob 124 controls the flow of the fluid from the second canister 118 by means of the oil ratio cylinder 126, which element is illustrated in greater detail in the exploded FIG. 7 and in FIG. 8A. This element is called an oil ratio cylinder 126 because in the preferred embodiment the second canister 118 is an oil canister; however, it should be appreciated that such nomenclature is for convenience sake only since the second canister could hold any substance, such as a pesticide or a food ingredient for example. Similarly, other structures and/or elements that are prefixed with the word "oil" or "fuel" are similarly done for convenience purpose only, and should not be construed to limit or otherwise dictate what fluids or substances may be used in this device.

The oil ratio cylinder 126 is fitted within the nozzle housing 114 so as to allow it to rotate freely, which rotation is controlled by the ratio adjustment knob 124. In order to prevent any oil from leaking into or otherwise escaping from the housing 114 from around the oil ratio cylinder 126, sealing O-rings 128 are provided and fitted within O-ring grooves 130. Control of the flow of oil through the oil ratio cylinder 126 is effected by means of a channel 132 disposed within the cylinder 126 whose unique shape provide oil flow at the specified ratios as selected by the ratio adjustment knob 124. Such ratios may be imprinted directly onto the ratio adjustment knob 124 and be visible within a window 134 in the housing assembly 116. By turning the ratio adjustment knob 124 to a desired ratio as visible in the window 134, the oil ratio cylinder 126 is rotated to the appropriate position, thereby changing the cross-sectional area of the channel 132 through which the oil may flow to thereby reduce or increase the flow of oil therethrough to be mixed with the fuel in the predetermined ratio. The ratio adjustment knob 124 may include fixed settings to which a user may merely click the knob 124 to allow for an exact ratio rather than a variable ratio, and one of the settings may be the "off" position allowing no oil to flow through the channel 132.

Figure 6B:
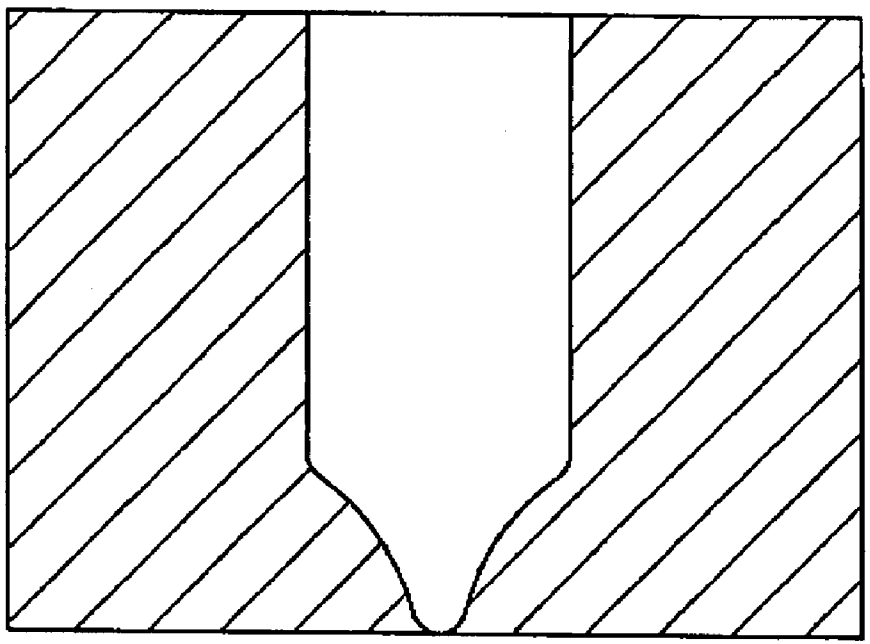
FIG. 6B is a front view of one embodiment of the oil ratio cylinder of the variably proportional mixing device of FIG. 1.
Figure 6A:
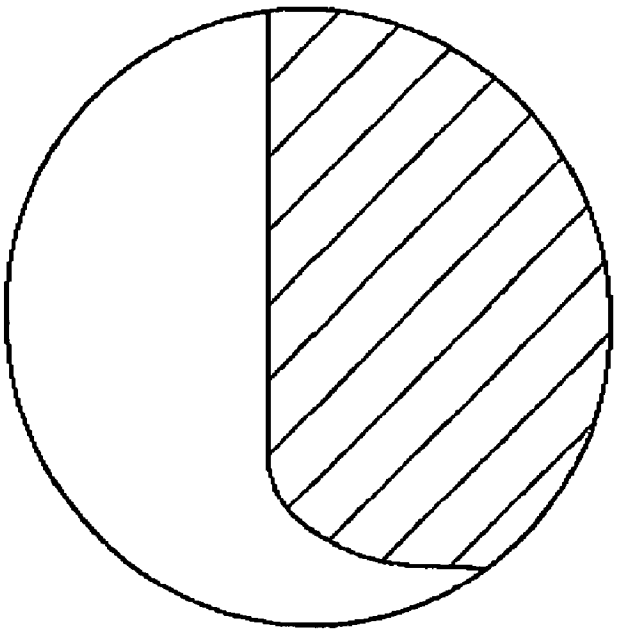
FIG. 6A is a side view of one embodiment of the oil ratio cylinder of the variably proportional mixing device of FIG. 1.

Illustrated in FIGS. 6A and 6B are the side and front views of the oil ratio cylinder 126 highlighting the variable cross-sectional width of the channel 132. It should be appreciated that by turning the oil ratio cylinder 126, the width and depth of the channel 132 through which the oil may pass is varied, thereby allowing a user to regulate the flow of oil through the oil ratio cylinder 126. The shape of the channel 132 is designed so as to allow for a given fluid flow therethrough for each of the predetermined fluid ratios. For example, it has been determined that, for oil-gas applications, the following mixtures are desirable, and the cross-sectional area of the channel 132 for each particular ratio follows each:

| | Gas Outlet Diameter | | Cross-Sectional Area | |
|---|---|---|---|---|
| | Inches | Millimeters | Inches^2 | mm^2 |
| Given: | 0.75 | 19.0 | .442 | 283.5 |

| | Channel Diameter | | Cross-Sectional Area | |
|---|---|---|---|---|
| Oil-Gas Ratio | Inches | Millimeters | Inches^2 | mm^2 |
| 1:5 | 0.33 | 8.5 | 0.088 | 56.7 |
| 1:7 | 0.28 | 7.2 | 0.063 | 40.5 |
| 1:8 | 0.26 | 6.7 | 0.055 | 35.4 |
| 1:10 | 0.24 | 6.0 | 0.044 | 28.4 |
| 1:12 | 0.22 | 5.5 | 0.037 | 23.6 |
| 1:16 | 0.19 | 4.8 | 0.027 | 17.7 |
| 1:20 | 0.17 | 4.2 | 0.022 | 14.2 |
| 1:24 | 0.15 | 3.9 | 0.018 | 11.8 |
| 1:32 | 0.13 | 3.4 | 0.014 | 8.9 |
| 1:38 | 0.12 | 3.1 | 0.012 | 7.5 |
| 1:42 | 0.12 | 2.9 | 0.010 | 6.8 |
| 1:50 | 0.11 | 2.7 | 0.009 | 5.7 |
| Off | — | — | | |

The benefits of using a oil ratio cylinder 126 having a channel 132 of varying cross-sectional areas are numerous, including the fact that such part is easy to manufacture and replace, and can include any number of fixed, predetermined settings guided by clicks that allow for extremely accurate measurements.

An additional feature of the oil ratio cylinder 126 is a vent detail 136 which is essentially a shallow channel that runs circumferentially around the cylinder 126, which vent detail 136 cooperates with a vent tube 138 to allow venting of the second canister 118.

Control of the flow of fluid from the first canister 102 is effected by means of a fuel cylinder 140, which structure is attached to and rotated by the handle 120. The fuel cylinder 140 essentially has two positions—a "closed" position in which no fuel is allowed to flow therethrough, and an "open" position which allows fuel to flow. The handle 120 and the fuel cylinder 140 are kept in the "closed" position by means of a torsion spring 142 which applies rotational force to keep the fuel cylinder 140 rotated to a position whereby access to the first and second canisters 102, 118 are blocked.

A fuel orifice 144 is provided within the fuel cylinder 140, which orifice 144 is essentially a cylindrical passageway through the entire body of the fuel cylinder 140 having a fixed cross-sectional area. A second passageway is also provided in the fuel cylinder 140, the cross orifice 146, which passageway leads from the oil ratio cylinder 126 to the fuel orifice 144 to allow the flow of oil from the second canister 118.

Also disposed within the fuel cylinder 140 are O-ring grooves 130 which accept sealing O-rings 128 to prevent the leakage of oil or fuel, as well as vent holes 148, which cooperate with vent detail 136 and vent tube 138 to allow for venting of the first and second canisters 102, 118. Venting is further effected by means of a rear vent tube 150 which in the preferred embodiment is made part of the nozzle housing 114 as well as a front vent tube 152.

Oil ratio cylinder 126 and fuel cylinder 140 are interconnected by means of oil seal 154 which in the preferred embodiment is composed of rubber and includes an opening 156 therein that allows the flow of oil from the second canister 118 into the fuel cylinder 140 while prevent leakage of any fluids. Also disposed within the oil seal 154 is a vent hole 148 that corresponds to the position of the vent detail 136 in the oil ratio cylinder and the vent hole 148 in the fuel cylinder 140 when the fuel cylinder is in the "open" position.

Situated immediately adjacent to the fuel cylinder 140 within the nozzle housing 114 is a fuel seal 158 whose purpose is to prevent any fluids from leaking around the oil ratio and fuel cylinders 126, 140. The fuel seal 158 also includes an opening 160 as well as a vent hole 148 that connects to the front vent tube 152 to allow for venting of gases.

A nozzle 162 is provided to direct the flow of the fuel-oil admixture and to assist the mixing of the components thereof. The nozzle 162 includes one or more static mixers 164 to assist in the mixing of the oil and fuel. The static mixers 164 comprise structures that interrupt the flow of the fluid and induce turbulence within the fluid to thereby effectively mix the component elements.

Figure 7A:
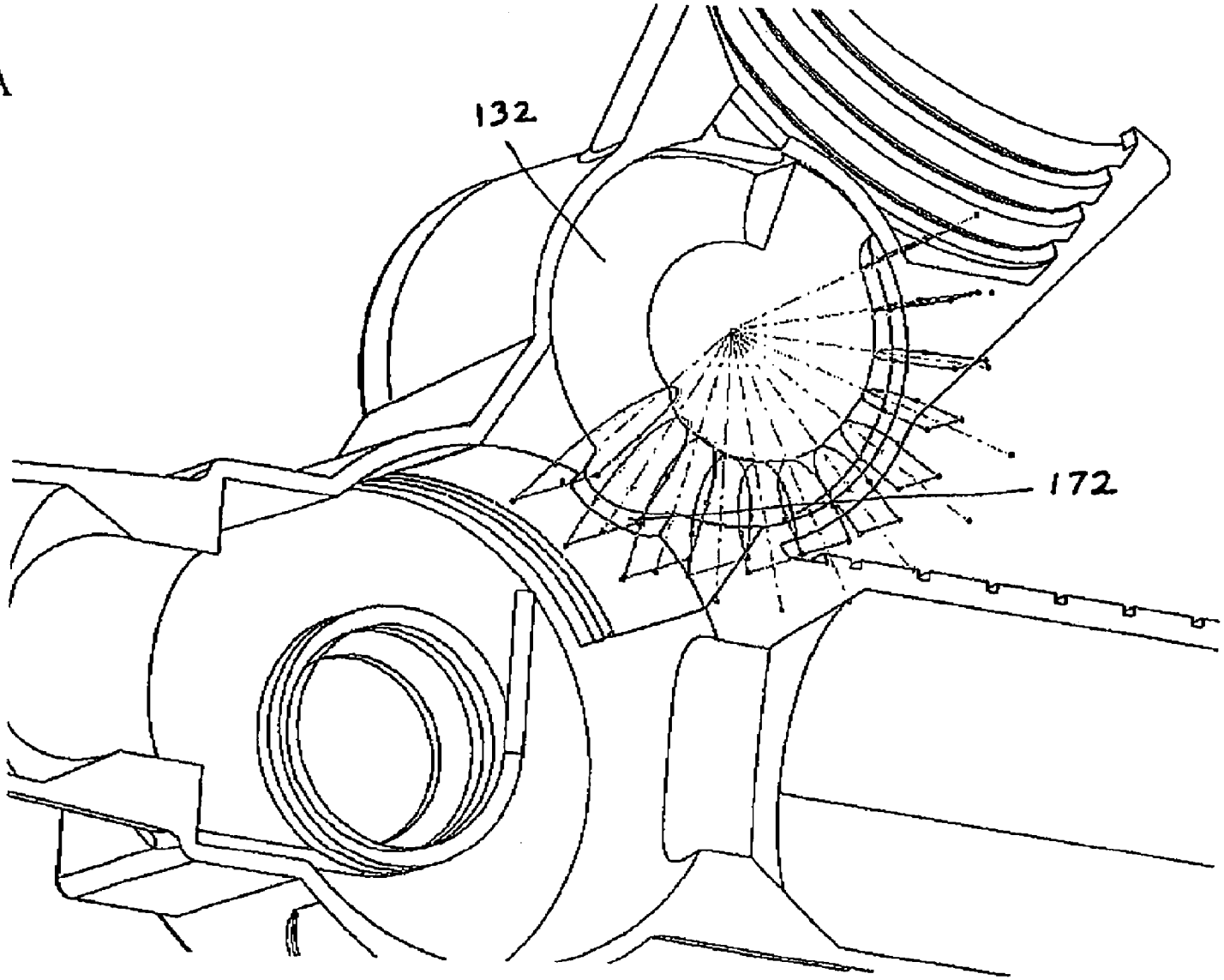
FIGS. 7A-7E are front elevational and perspective views of the preferred embodiment of the oil ratio cylinder of the variably proportional mixing device of FIG. 1 wherein such cylinder is shown in various positions from all the way open to closed.
Figure 7B:
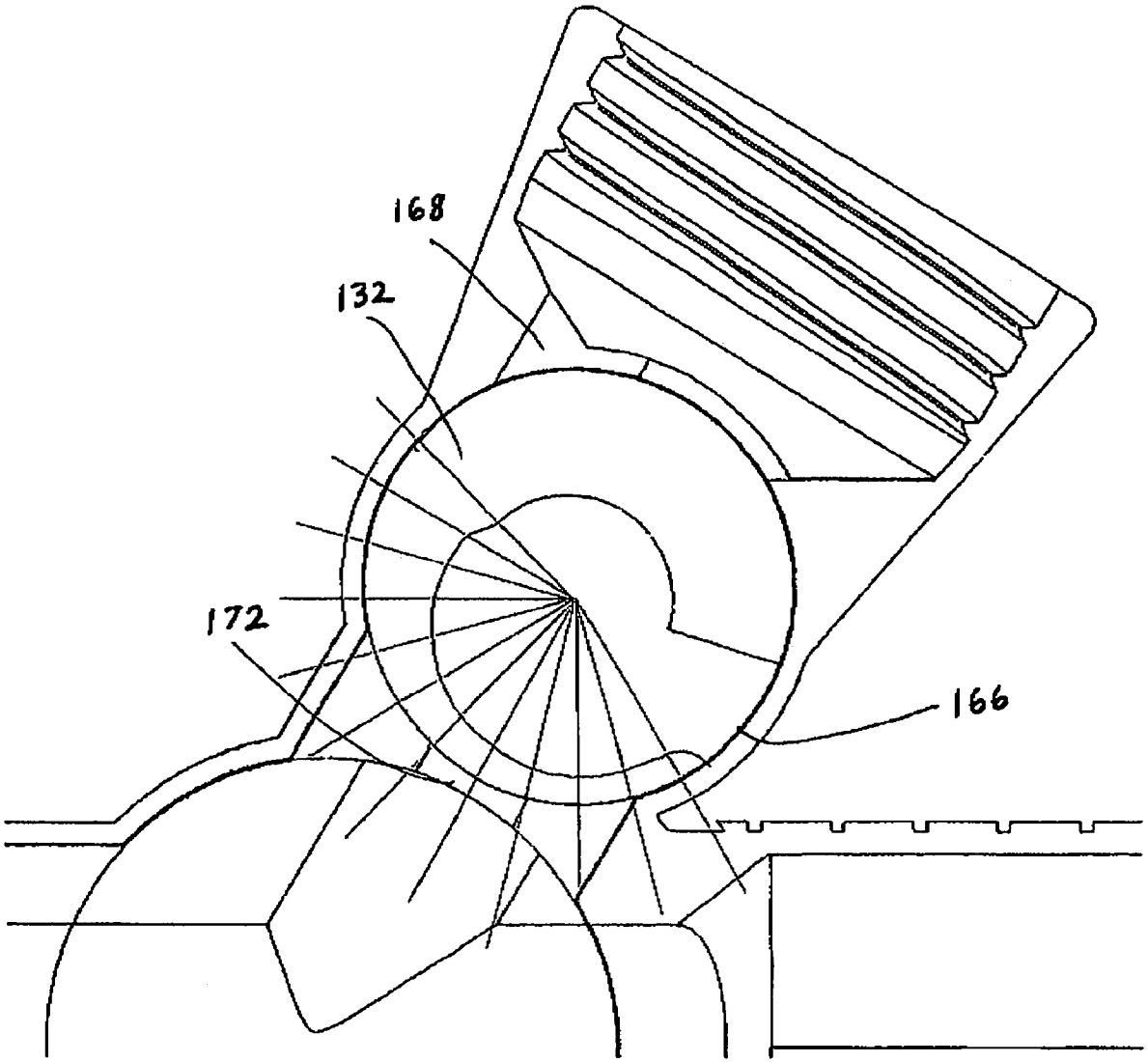
Figure 7C:
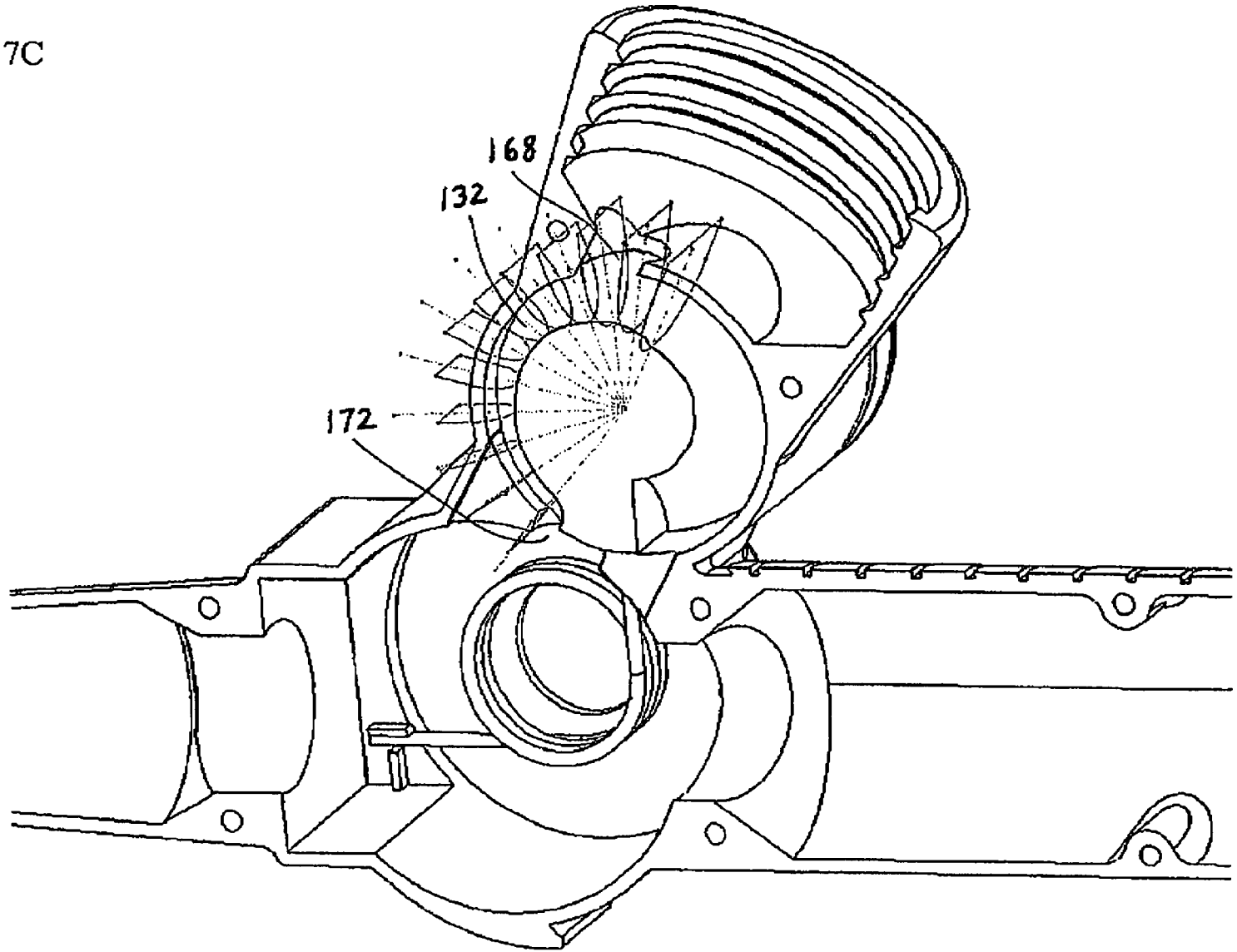
Figure 7D:
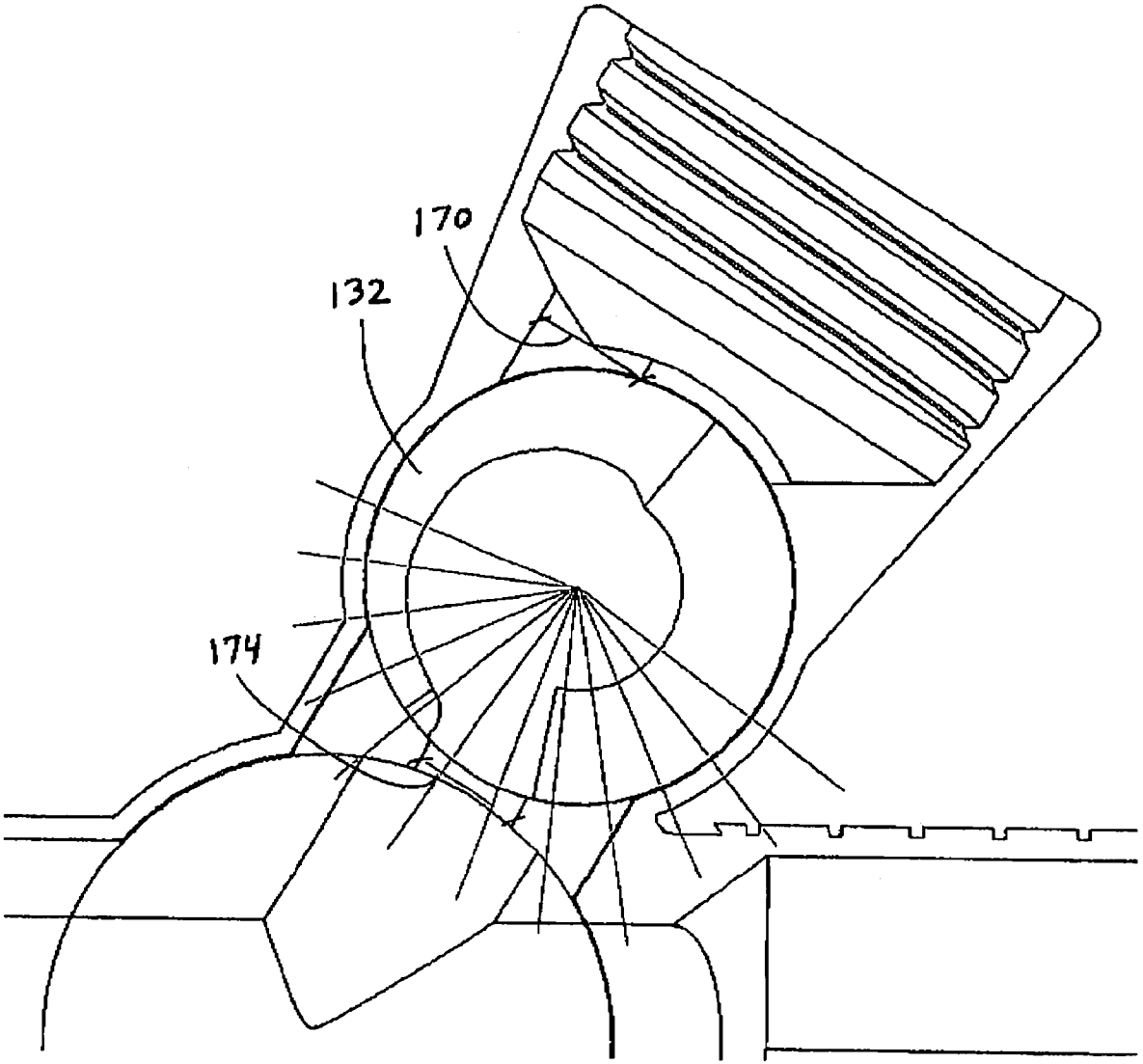
Figure 7E:
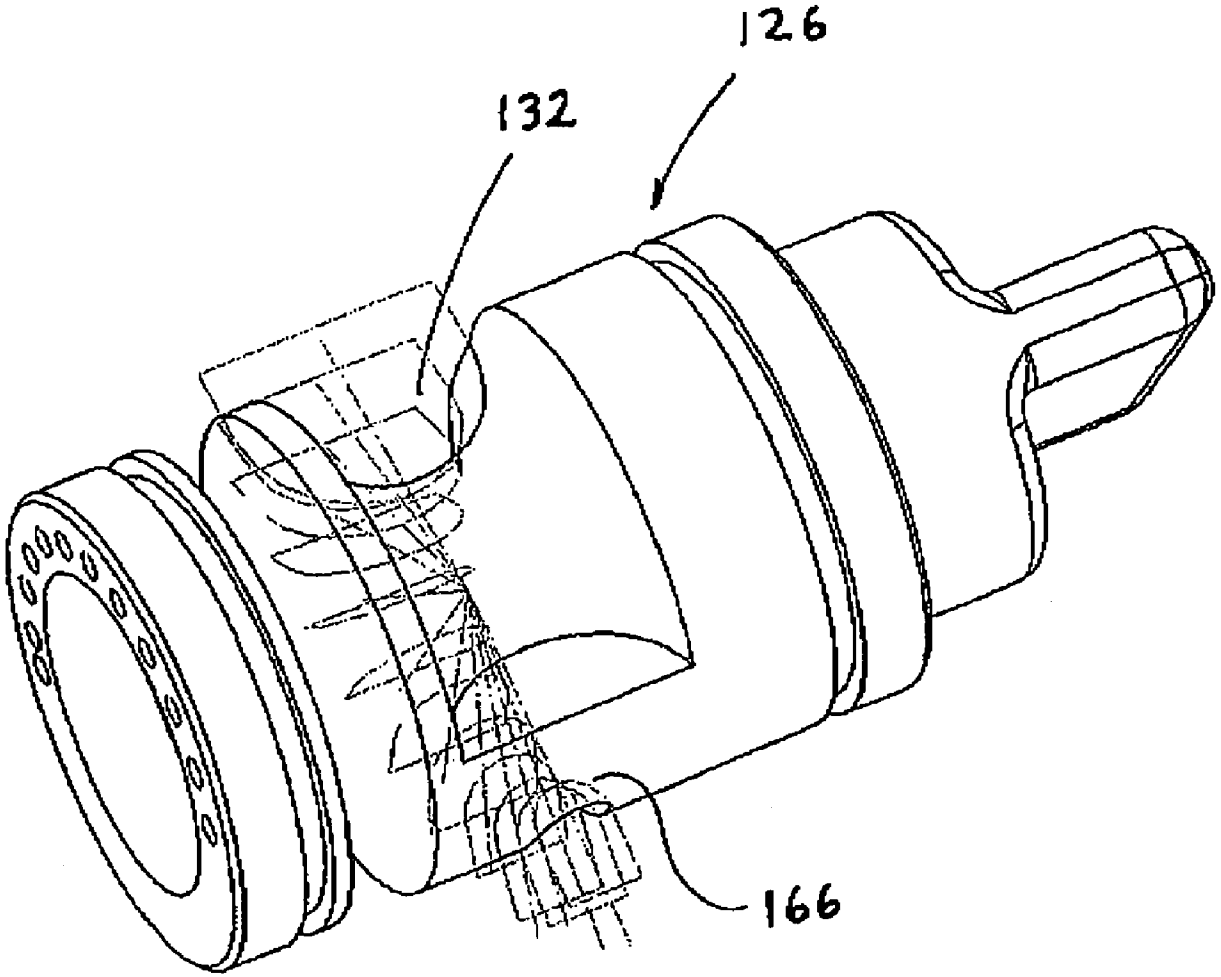

Illustrated in FIGS. 7A-7E is the preferred embodiment of the oil ratio cylinder 126 of the present invention. In such embodiment, the channel 132 encircles the entire circumference of the oil ratio cylinder 126 but for an uninterrupted portion 166, which portion 166 serves to block the flow of oil when the oil ratio cylinder 126 is in the closed position (as illustrated in FIG. 7D). It can be seen that the depth of the channel 132 varies with the radial position around the circumference of the oil ratio cylinder 126, said variable depth serving to limit the flow of the oil through the cylinder 126 depending upon the position selected by the ratio adjustment knob 124.

In all embodiments, the oil flows into the oil ratio cylinder 126 through the oil inlet 168 having a fixed inlet cross-sectional area 170, and exits through the oil outlet 172 having a fixed outlet cross-sectional area 174. The cross-sectional areas 170, 174 should be sufficiently large to allow for the free flow of oil through the oil ratio cylinder 126 in all positions. In the preferred embodiment, the uninterrupted portion 166 must be at least as large in size and shape as the outlet cross-sectional area 174 such that, in the closed position, the uninterrupted portion 166 completely covers and seals the outlet cross-sectional area. The depth of the channel 132 at each position of the ratio adjustment knob 124, and thereby the cross-sectional area of the channel 132 through which the oil passes to the oil outlet 172, has been carefully determined so as to allow for the specific amount of oil to consistently pass through the oil ratio cylinder 126.

In the embodiment of FIGS. 7A-7D, the oil ratio cylinder 126 may be rotated through 180 degrees of rotation to select different oil to gas ratios. It should be appreciated that in order to achieve this 180 degrees of rotation, the channel 132 must extend more than 180 degrees around the circumference of the oil ratio cylinder 126 to allow for passage of oil in any position. It should also be appreciated that such configuration may result in oil filling the entire channel to either side of the oil inlet 168, although the oil outlet 172 will be situated at only one end of the channel 132. This does not in any way affect the performance of the oil ratio cylinder 126.

The operation of the automatic closure apparatus 100 is a relatively simple endeavor. The nozzle housing 114 is screwed onto the first canister 102 using the adapter ring 104, and the second canister 118 is screwed onto the housing assembly 116. During attachment of the canisters 102, 118, the handle 120 is not depressed, allowing the torsion spring 142 to force the fuel cylinder 140 and oil orifice closed, thereby blocking the flow of any fluid therethrough, and the ratio adjustment knob 124 is set to "off." Both the oil ratio cylinder 126 and the fuel cylinder 140 prevent the flow of oil in this position.

A user then selects a particular oil-fuel ratio by turning the ratio adjustment knob 124, which rotates the oil ratio cylinder 126 to the appropriate position, thereby allowing oil to pass through the channel 132. The flow of oil through the oil ratio cylinder 126 is limited by the depth of the channel 132 and the cross-sectional area of the portion of the channel 132 that is immediately adjacent to the oil outlet 172. Further passage of oil through the apparatus 100 may still be prevented by the fuel cylinder 140 if it is in the "closed" position. By depressing or squeezing the handle 120, force is applied to counter the force of the torsion spring 142, thereby rotating the fuel cylinder 140 and revealing the fuel orifice 144 to allow for passage of fuel from the first canister 102 and the flow of oil from the oil ratio cylinder 126 through the fuel seal 158 and into the cross orifice 146.

Fluids from the first and second canisters 102, 118 are introduced in the fuel cylinder 140 where they begin to mix as they pass through the fuel seal 158 into the nozzle 162. Mixing is completed as the fuel and oil pass the static mixers 164 which serve to disturb the flow of fluid and create turbulence within the flow.

Having thus described the invention with particular reference to the preferred forms thereof, it will be obvious that various changes and modifications can be made therein without departing from the spirit and scope of the present invention as defined by the appended claims.

I claim:

1. A device for automatically mixing two fluids, a first fluid stored in a first container and a second fluid stored in a second container, said mixing occurring in operator selectable ratios, said device comprising:

a first receiving port for mechanically connecting to and fluidly coupling with said first container;

a second receiving port for mechanically connecting to and fluidly coupling with said second container;

a nozzle for dispensing said mixture;

an external ratio adjustment knob for selecting a said mixture ratio;

a ratio control cylinder having an input side and an output side;

said second receiving port in fluid communication with said input side of said ratio control cylinder;

a flow control cylinder having a first input orifice, a second input orifice, and an output orifice; said flow control cylinder operable between an open position and a closed position;

said output side of said ratio control cylinder in fluid communication with said second input orifice of said, flow control cylinder when said flow control cylinder is in said open position;

said first receiving port in fluid communication with said first input orifice of said flow control cylinder when said flow control cylinder is in said open position;

said nozzle in fluid communication with said output orifice of said flow control cylinder when said flow control cylinder is in said open position; and whereby when said flow control cylinder is operable in said open position, said fluids flow from their respective containers though said device, mixing according to the operator selected ratio and dispense from said nozzle.

2. The device of claim 1, further comprising an adaptor ring for adaptably attaching said first receiving port to said first container.

3. The device of claim 1, wherein said second container is mechanically coupled with said second receiving port by a set of matching male and female threads, one of each threads disposed upon one of each said container and said second receiving port;

wherein said second container threadedly mated to said second receiving port creating a fluid tight seal.

4. The device of claim 1, and further comprising an external ratio adjustment knob mechanically connected to said ratio control cylinder;

whereby said mixture ratio is selected by an operator rotating the knob to one of a selectable ratio setting.

5. The device of claim 4, wherein said flow control cylinder is operable between said open position and said closed position; and said fluid communication between said nozzle and each said container is interrupted when said flow control cylinder is in said closed position.

6. The device of claim 5, and further comprising a handle attached to said flow control cylinder, said handle serving to rotate said flow control cylinder between said open and said closed position.

7. The device of claim 6, further including a torsion spring disposed on said flow control cylinder, said torsion spring serving to exert rotational force on said flow control cylinder to thereby rotate said flow control cylinder to the closed position.

8. The device of claim 7, wherein said flow control cylinder includes a first passageway therethrough for the passage of said first fluid from said first container and an orifice for the passage of said second fluid from said second container to said passageway when said flow control cylinder is in the open position.

9. The device of claim 8, and further comprising an operator selectable off position for said ratio control cylinder;

said ratio control cylinder off position interrupting fluid communication between said second container and said input side of said ratio control cylinder;

whereby when said ratio control cylinder is in said off position and said flow control cylinder is in said open position, only said first fluid flows through and is dispense by said device.

10. The device of claim 9, wherein said ratio control cylinder is attached to said ratio adjustment knob and said ratio control cylinder includes a fluid channel having a variable cross-sectional area such that the operation of said ratio adjustment knob causes said cross-sectional area to change and thereby after the flow rate of said second fluid from said second container.

11. The device of claim 10, wherein said control ratio cylinder and said flow control cylinder include O-ring grooves, further including sealing O-rings disposed within said O-ring grooves.

12. The device of claim 11, wherein said ratio control cylinder and said flow control cylinder include vents.

13. The device of claim 12, further including at least one venting tube.

14. The device of claim 13, further including an oil seal disposed between said ratio control cylinder and said flow control cylinder.

15. The device of claim 14, wherein said nozzle further comprises a fluid mixer.

16. The device of claim 15, and further comprising at least one static mixer disposed within said nozzle.

17. A method for mixing two fluids, a first fluid stored in a first container and a second fluid stored in a second container in various predetermined ratios without measuring, said method comprising:

attaching said first container to said device;

attaching said second container to said device;

selecting a predetermined fluid ratio by rotating a selector knob to the desired setting;

said knob providing mechanical rotation to an internal ratio control cylinder;

said ratio control cylinder providing a variable width canal to limit the flow of said second fluid;

rotating said device about a transverse axis so that both said first and second containers are positioned above said device;

depressing a flow control handle from a closed to an open position;

whereby gravity causes said fluids to flow through the device producing a mixture of the two said fluids in the ratio selected by the operator.

18. A device as in claim 1 wherein said fluids are propelled from their said respective containers through said device solely by the force of gravity.

* * * * *